United States Patent [19]

Fey et al.

[11] Patent Number: 4,880,947

[45] Date of Patent: Nov. 14, 1989

[54] VACUUM INTERRUPTER WITH SIMPLIFIED ENCLOSURE AND METHOD OF ASSEMBLY

[75] Inventors: Maurice G. Fey, Pittsburgh; William J. Lange; Carl B. Freidhoff, both of Murrysville; Paul G. Slade, Pittsburgh, all of Pa.

[73] Assignee: Westinghouse Electric Corp., Pittsburgh, Pa.

[21] Appl. No.: 212,850

[22] Filed: Jun. 29, 1988

[51] Int. Cl.[4] ..... H01H 33/66

[52] U.S. Cl. ..... 200/144 B; 200/302.2

[58] Field of Search ..... 200/144 B, 302

[56] References Cited

U.S. PATENT DOCUMENTS

| | | | |
|---|---|---|---|
| 1,935,228 | 11/1933 | Kopeliowitsch | 200/144 |
| 3,267,247 | 8/1966 | Ross | 200/168 |
| 3,812,314 | 5/1974 | Nonken | 200/144 B |
| 3,924,087 | 12/1975 | Clason | 200/144 B |
| 3,944,771 | 3/1976 | Kohler | 200/144 B |
| 3,997,747 | 12/1976 | King | 200/144 B |
| 4,345,126 | 8/1982 | Cherry et al. | 200/144 B |
| 4,440,995 | 4/1984 | Lange et al. | 200/144 B |
| 4,450,327 | 5/1984 | Yanagisawa | 200/144 B |
| 4,540,863 | 9/1985 | Bettge | 200/144 B |
| 4,618,749 | 10/1986 | Bohme | 200/144 B |
| 4,672,156 | 10/1987 | Basnett | 200/144 B |

OTHER PUBLICATIONS

Torr Seal, Varian Vacuum Division, 611 Hansen Way, Palo Alto, CA 94303–Oct. 1967.

Preliminary Technical Bulletin 3–2–13, Eccobond 104, Emerson & Cuming, Inc., Canton, MA (Revised 3–1–68).

*Primary Examiner*—Robert S. Macon

*Attorney, Agent, or Firm*—G. H. Telfer

[57] ABSTRACT

An electrical vacuum interrupter comprising a pair of separable contacts enclosed within a vacuum enclosure whose walls have joints formed of a polymeric material which can maintain sufficient vacuum, mechanical, thermal, and electrical properties to permit proper operation. Major part of the vacuum enclosure, in addition to the joint, may be formed of a polymeric material. A method of assembly is provided that avoids need for high temperatures and includes use of electrical discharge between the contacts for cleaning the interior of the vacuum enclosure.

20 Claims, 3 Drawing Sheets

VACUUM INTERRUPTER WITH SIMPLIFIED ENCLOSURE AND METHOD OF ASSEMBLY

BACKGROUND OF THE INVENTION

1. Field of the Invention

This invention relates to vacuum interrupters and, more particularly, to vacuum interrupters whose vacuum enclosures utilize polymeric systems, such as a cured epoxide resin, for sealing and may additionally utilize such systems for one or more other parts of the vacuum enclosures.

2. Description of the Prior Art

Conventional vacuum interrupters are constructed of enclosures of ceramic or glass insulators, which are metallized and brazed to support metallic members, such as of stainless steel or copper-nickel alloys, in turn joined to copper contact rods. A metal bellows on one end of the enclosure allows motion of one contact brazed to one of the contact rods. Within the insulators a protective shield may be provided to prevent thermal shock and metallic contamination from depositing onto the insulators as a result of arc erosion of the contacts during the operation of the interrupter.

Vacuum interrupters have high production costs due to the expensive, high quality materials and processing required which have limited their application to medium and low voltage switching apparatus and large motor contactors. Following assembly and then simultaneous evacuation and braze sealing in vacuum furnaces, the internal pressure in the vacuum interrupter is typically less than about $10^{-6}$ Torr. In service, the internal pressure in a medium voltage interrupter for switchgear may not generally exceed about $2\times10^{-3}$ Torr. Vacuum interrupters for 600 volt class contactors may not exceed internal pressures on the order of $10^{-1}$ to $10^{-2}$ Torr. Such vacuums must be maintained over a service life of many years.

A conventional vacuum interrupter requires a number of expensive parts and processing steps to achieve a high quality, long endurance vacuum enclosure. These include:

(1) gastight ceramic tubes (typically alumina) which are dimensionally stable and expensive to produce to the required close tolerances, and which must be capable of several excursions to high temperatures (typically up to about 1550° C.) for metallizing and brazing;

(2) the ends of the ceramics must be coated with metal bearing slurries and subsequently fired in a controlled composition atmosphere furnace to provide a metallized surface to which brazing alloys will adhere for impervious and strong joints; and (3) stainless steel bellows which are subject to multiple excursions to temperatures up to about 1000° C. for brazing.

It is desirable to provide quality vacuum interrupters with lower cost materials and lower temperature processing with fewer heating cycles.

SUMMARY OF THE INVENTION

In accordance with this invention, a vacuum interrupter is provided which comprises a housing including an envelope forming an evacuated chamber and including at least one open end; a closure for each open end and the closure having a joint with the envelope; a pair of separable contacts within the envelope; a vacuum-tight seal at the joint composed of a polymeric system, whereby upon thermal cycling of the interrupter during assembly and subsequent use, the seal remains intact. The envelope may be of a polymeric system as well as a metal alloy, glass or ceramic.

A polymeric material or system for use in the present invention is resinous material that when cured achieves the required physical properties for vacuum interrupter applications and is generally characterized as having a relatively high glass transition temperature and a high degree of stability over the conditions of use without appreciable dimensional change or out-gassing of constituents. Suitable polymeric systems are found among epoxy resin systems which include an epoxy resin, mixed with a catalyst and a filler. Epoxy resin systems in general have of course been used for many different enclosures and sealing applications. The characteristics required for use in sealing and enclosing vacuum interrupters can be found among available, known, epoxy resin systems by careful selection criteria and testing.

A method of assembly of a vacuum interrupter in accordance with the present invention generally comprises forming contact subassemblies of the contacts, rods and bellows (for the movable contact); joining the contact subassemblies with any end plates; providing insulating housing members in assembled relation with the contact subassemblies and end plates; and sealing the insulating housing members together using a polymeric system as a sealant. The sealing process includes fully curing the polymeric system. The housing is evacuated, such as through a tubulation. Vacuum pumping is continued while applying a voltage producing an electrical discharge between the contacts to assist in cleaning all surfaces without a necessity to reach temperatures that could harm the polymeric system. Then the evacuation port of the housing is sealed.

Metallurgical joints, such as by welding, brazing, or soldering, are not required in accordance with this invention for final assembly. Subassemblies however may still be formed by such techniques while still achieving major advantages with the invention.

Devices made in accordance with this invention eliminate a number of expensive parts and processing steps so that vacuum switching technology can be economically used in such applications as for small size, high volume contactors, load break switches, tap changers, and similar electrical devices, as well as in applications where vacuum interrupters have been used previously.

DESCRIPTION OF THE PREFERRED EMBODIMENT

Figure 1:
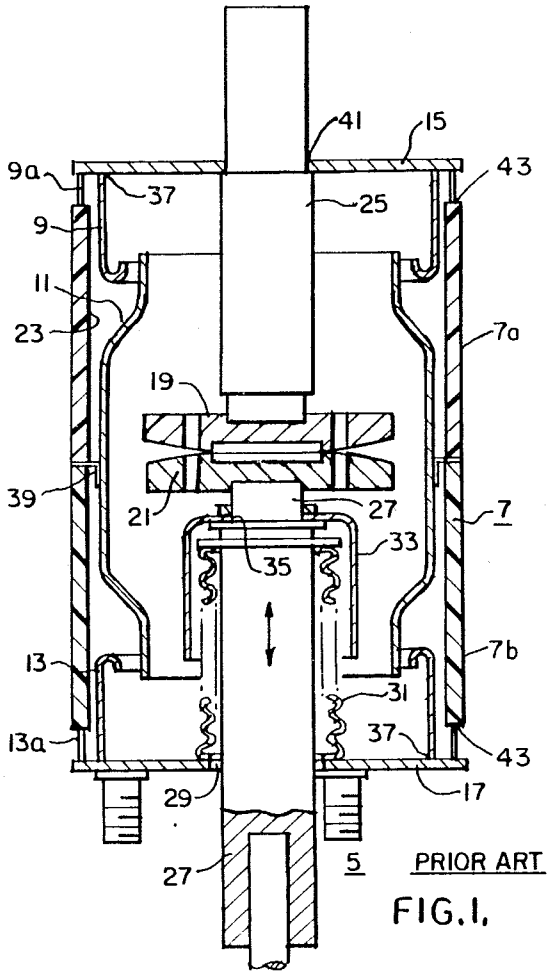
PRIOR ART FIG. 1.
FIG. 1 is a sectional view of a vacuum interrupter of prior art construction.

A vacuum interrupter of prior art construction is generally indicated at 5 in FIG. 1. It comprises an insulating enclosure or envelope or housing 7, vapor condensation shields 9, 11, and 13, and end closures or plates or flanges 15, 17. A pair of separable contacts 19, 21 are disposed centrally of a vacuum chamber 23 formed by the envelope 7 and the end closures 15, 17. The contact 19 is mounted on the lower end of a conductor or terminal 25. The contact 21 is movable from the contact 19 and is mounted on a conductor or terminal 27 which is movable longitudinally through a hole 29 in the closure 17.

A flexible metallic bellows 31 is disposed between the conductor 27 and the closure 17 to maintain a vacuum within chamber 23 while allowing movement of terminal 27. A vapor condensation shield 33 is mounted on the conductor 27 at 35 and extends downwardly over the upper portion of the bellows to prevent vapor condensation on the bellows. The vapor condensation shields 9, 13 are secured to the closures 15, 17, respectively, in a suitable manner such as by brazing at 37. The shield 11 is secured in place on the envelope 7 by a support flange 39. The envelope may be comprised of two abutting envelope halves *7a* and *7b*. The flange 39 is brazed into the joint between the envelope halves *7a* and *7b*.

The conductor 25 extends through a hole in the closure 15 where it is secured in a vacuum-tight manner, such as by brazing at 41.

In accordance with prior art construction, the envelope halves *7a* and *7b* are comprised of a ceramic material or glass. The upper and lower ends of the envelopes are secured in a metal-to-glass or ceramic vacuum-type manner to similar annular flanges *9a*, *13a* of the end shields 9, 13. The vacuum seals are accomplished by abutting the ends of the flanges *9a*, *13a* onto the surface of the envelope halves *7a* and *7b* where they are secured at 43 by a suitable high temperature metal brazed seal. Where ceramics are used, the vacuum seals 43 are generally accomplished by brazing. Uniform adhesion of the brazing material to the ceramic generally requires that the ceramic joint surface be metallized, which is a multi-step process in which multiple metal films are deposited for adequate adhesion of the brazing alloy to provide leak-free joints.

Conventional vacuum interrupters of the type shown in FIG. 1 are costly to manufacture because of a number of expensive parts and processing steps, including, in particular, gas tight ceramic tubes (typically alumina), which are dimensionally stable and whose end portions are produced to close tolerances, and uniform, leak-free stainless steel bellows which are difficult and expensive to manufacture.

Figure 2:
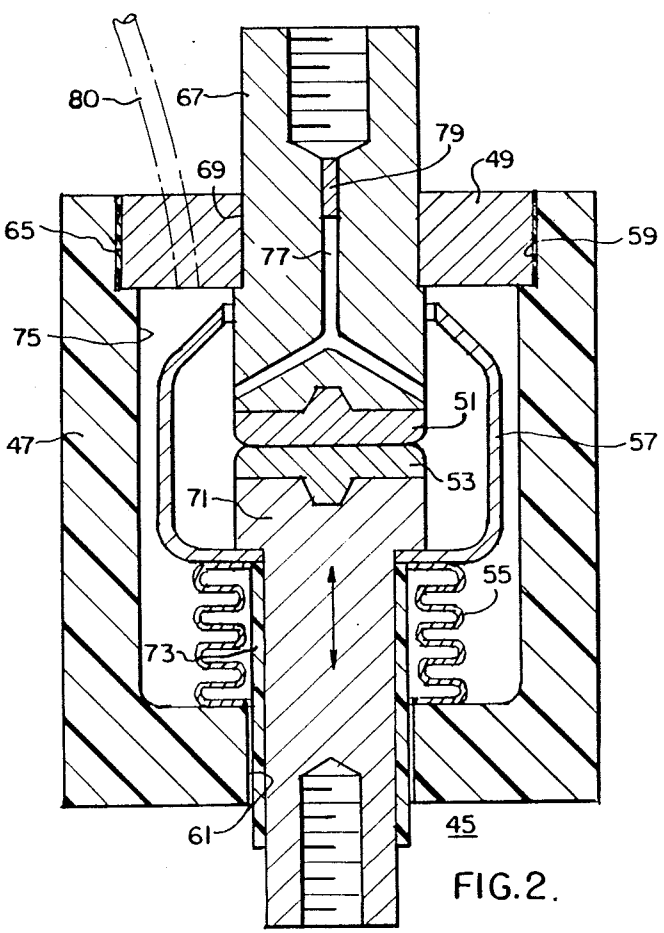
FIG. 2 is a sectional view of a vacuum interrupter in accordance with one embodiment of the present invention.
Figure 3:
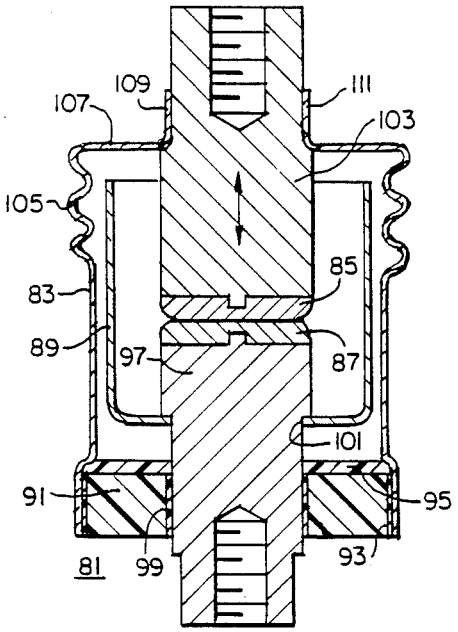
FIG. 3 is a sectional view of a vacuum interrupter in accordance with another embodiment of the present invention.
Figure 4:
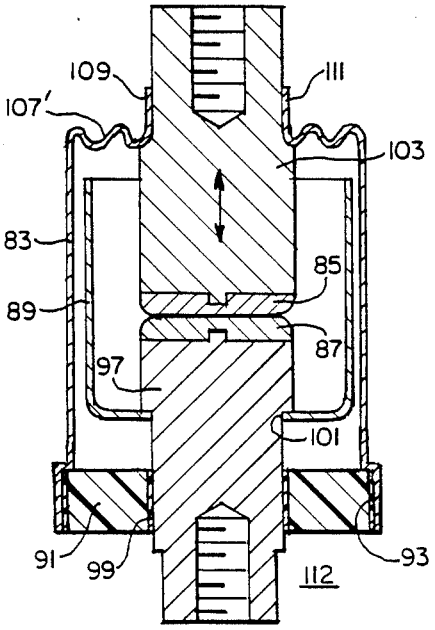
FIG. 4 is a sectional view of a further embodiment of a vacuum interrupter in accordance with the invention.

In accordance with this invention, the vacuum interrupters shown in FIGS. 2, 3, and 4 are proposed as less expensive replacements. In FIG. 2 a vacuum interrupter 45 consists of an enclosure or envelope or housing 47, an end closure 49, a pair of separable contacts 51, 53, bellows 55, and a vapor condensation shield 57. The envelope 47 is preferably a molded insulating enclosure having a generally cup-shaped configuration with an upper opening 59 and a lower opening 61 (referring to the orientation illustrated). Enclosure 47 may alternatively be of ceramic or glass. The closure 49 is disposed in the upper opening 59 and a sealant 65 is disposed in a joint between the closure 49 and the surrounding envelope 47 to provide a vacuum-tight joint. The sealant 65 is a cured polymer system, such as an epoxy resin system.

The end closure 49 is composed of a metal such as copper, suitable for supporting a conductor or terminal 67 at a joint 69 which is brazed for supporting the conductor in an airtight manner.

The contact 51 is secured to the lower end of the conductor 67. The contact 53 is mounted on a conductor or terminal 71 which is movable through the lower opening 61. The shield 57 is fixedly mounted on the conductor 71. The bellows 55 extends between the surface of the envelope 47 around the opening 61 and the conductor 71 adjacent to the shield 57 for providing a vacuum tight seal between the opening 61 and the interior of the envelope in a conventional manner. A bushing 73 of a suitable material, such as a polymeric material, can be mounted on the outer surface of the conductor 71 to protect the bellows from wear on the movable conductor 71. The lower end of the bellows 55 is molded either into or onto envelope 47. The interior vacuum enclosure 75 of the vacuum interrupter 45 may be evacuated in a suitable manner, such as through passages 77 in the conductor 67 which passages are sealed by a plug 79 when evacuation is completed, or through auxiliary tubulation 80.

Another embodiment of the invention is shown in FIG. 3 in which a vacuum interrupter is generally indicated at 81. The vacuum interrupter 81 is comprised of an enclosure or envelope or housing 83, such as of metal, enclosing a pair of separable contacts 85, 87 and a vapor shield 89. The lower end of the envelope 83 is closed by an insulating barrier or closure 91 which may be composed of a cast polymeric system which is secured in place at the joint between the barrier 91 and the envelope 83 by an adhesive 93 such as an epoxy sealant.

An optimal diffusion barrier 95 which is composed of glass, ceramic, or other insulating material may be provided on the inner surface of the barrier 91 to prevent any substance that may diffuse through the insulation barrier 91 from affecting the normal arcing activity between the contacts 85, 87. The diffusion barrier 95 is preferably secured in place by the adhesive 93 in a manner similar to that for holding the insulating barrier 91 in place. Diffusion barrier 95 is an example of the use of an additional housing element with a cast epoxy member 91 for even more secure enclosing, while retaining seal 93. It is not considered that such a barrier 95 will normally be required.

The contact 87 is stationary and is fixedly mounted on a conductor or terminal 97 which extends through aligned openings in the barriers 95, 91 where it is secured in place by an adhesive 99, such as a polymeric system.

As shown in FIG. 3, shield 89 is a cup-shaped member having an aperture 101 to enable mounting on the conductor 97. The shield 89 extends upwardly around the contacts 85, 87 for preventing contamination of the envelope 83 when the contacts are separated. The contact 85 is mounted on the lower end of a conductor or terminal 103 which is movable by means (not shown) for opening and closing the contacts 85, 87.

The envelope 83 is composed of a metal, such as an aluminum, ferrous, or copper-base alloy, and includes an axially extending bellows portion 105 having a lateral portion 107 and an upturned flange 109 which is secured to the surface of the conductor 103. For that purpose a joint 111, which may be brazed, welded, or sealed by an epoxy resin, is disposed between the flange 109 and the conductor 103 in order to provide a vacuum-tight joint. The bellows portion 105 of the envelope 83 flexes with the movement of the conductor 103 during opening or closing of the contacts 85, 87. Thus, the vacuum within the envelope 83 is maintained.

In FIG. 4 still another embodiment of the vacuum interrupter is disclosed at 112. It differs from that shown in FIG. 3 in that it does not have a diffusion barrier 95 as shown in FIG. 3. Moreover, a radially-extending bellows portion 107' is employed as an alternative to the axial portion 105 of FIG. 3 and is likewise provided with a flange 109.

Vacuum interrupters 45, 81, and 112 (FIGS. 2, 3 and 4) illustrate example applications of the current invention for low voltage (up to about 600 volts) switches and contactors, in which a vapor shield is attached to one of the contact assemblies. In each example, the enclosure or envelope 47 or 83 is sealed to an end closure 49 or 91 by a cured polymeric material at 65 and 93. Those key seals greatly simplify fabrication even if brazed, soldered or welded seals are used elsewhere in the stucture; however, a cured polymeric material may also be used in other joints.

Where the level of diffusion and out-gassing in the epoxy sealed devices described herein are sufficiently low, the invention is also applicable to medium voltage switchgear vacuum interrupters.

Figure 5:
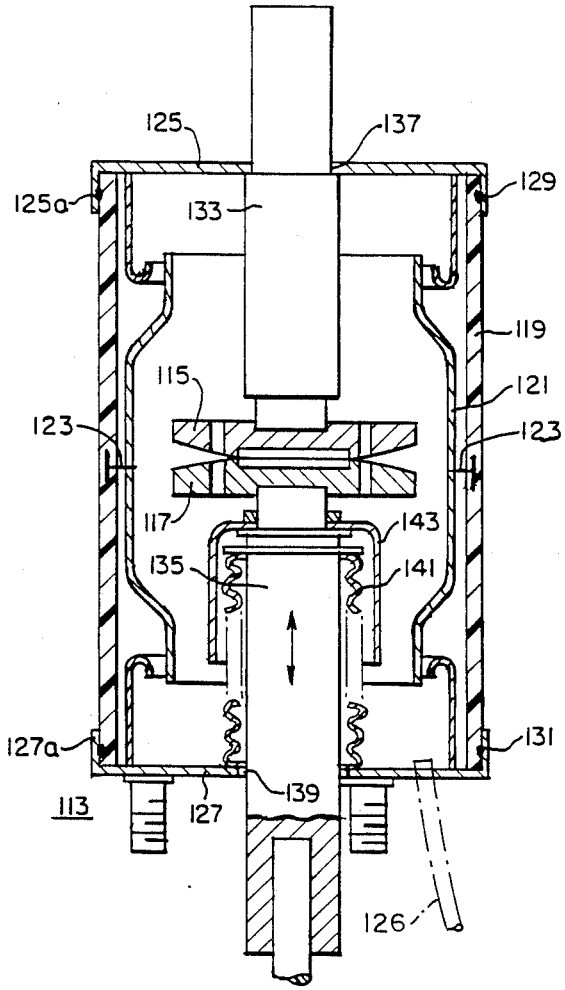
FIG. 5 is a vertical sectional view of a vacuum interrupter of still another embodiment of the invention.

In FIG. 5 a vacuum interrupter is generally indicated at 113 and it consists of separable contacts 115, 117, an enclosure or envelope, or housing 119, and a vapor shield 121 having spaced mounting flanges 123 which are molded into the envelope 119 for retaining the shield in place. The envelope 119 is comprised of a ceramic, glass, or a polymeric material having upper and lower ends which are closed by end caps 125, 127. The end caps include peripheral flanges **125*a* and 127*a*, respectively, which fit telescopically around the upper and lower end portions of the envelope 119 where they are secured in place in an airtight joint by an adhesive 129, 131**, such as a polymeric epoxy resin.

Within the envelope 119, the contacts 115, 117, are mounted on conductors or terminals 133, 135, respectively. The upper conductor 133 is fixedly mounted in place within the metal end cap 125 where it is secured in a vacuum tight joint 137, such as with an adhesive of epoxy resin or by brazing.

The lower conductor 135, being movable vertically, extends through an opening 139 in the lower metal end cap 127 and a vacuum tight fitting between the opening 139 and the interior of the envelope 119 is provided by a bellows 141 in a conventional manner, such as disclosed for the bellows 55 in FIG. 2. A protective shield 143 is mounted on the upper end portion of the conductor 135 to prevent contamination of the bellows 141. The vacuum tight joints between the upper and lower ends of the bellows 141 and the conductor 135 and the end cap 127, respectively, are provided by a polymeric material, or a braze.

Exhaust tabulation 126 is shown for evacuating the enclosure, by way of example.

In the several embodiments of the invention a conductor (such as 133) may be brazed to their respective metal closure (such as 125) at a joint (such as 137) in a manner as used in current practice. Such a subassembly may be formed separately from the main vacuum closure. Alternatively, a seal with a polymeric material may be used.

In accordance with the invention, during final assembly of the several parts, all joints between the interior of the vacuum interrupters and the exterior thereof involve seals effected through the use of polymeric materials. Evacuation can be carried out either following the assembly or concurrently with final assembly.

In accordance with this invention, an interrupter having an enclosure with vacuum sealed joints may be provided with any of a number of geometries comprising a vacuum bottle where the joints are secured by a cured polymeric system.

The materials of the polymeric system for seals or molded housing elements are selected to achieve good physical properties for vacuum interrupter applications. The system generally consists of a resin, a curing agent and a filler which, when cured, together determine the final characteristics. The cured system should be free of volatile constituents so the vacuum enclosure can operate over a temperature range of at least about −40° C. to about 125° C. while maintaining a vacuum-tight seal. Other characteristics, of course, include bondability with the structural materials used with sufficient tensile strength and sufficient electrical insulation qualities.

Epoxy resin systems offer good choices for the polymeric material. In contrast polyurethane materials are considered generally unattractive because of inability in satisfying the high temperature requirement. Also, polyurethanes have generally lower tensile strength than epoxies so that larger surface areas would be required to achieve equivalent bond strengths. Rubber like materials such as Viton material are considered generally unattractive because they are susceptible to permeation of water vapor.

In selecting a suitable material for the polymeric system, it was found useful to form samples and subject them to helium leak tests. Samples were formed of ceramic and Ni/Cu alloy parts as used for certain smaller size vacuum interrupters. Also, ceramic tubes sealed in one end by a flat Ni/Fe alloy plate were subjected to leak testing. In addition, there were tests made of assemblies of seal structures consisting of an epoxy washer with a copper rod through its center. All the samples were formed using the recommended curing schedule for the epoxy systems that were used. Thorough cleaning of the parts was also performed.

Helium leak tests were performed on the various samples, some at both room temperature and elevated (125° C.) temperature. Those considered to pass the tests are those where no leak was detectable by a helium leak detector which can sense leaks as low as $1\times10^{-10}$ standard cubic centimeters of air per minute.

In addition, out-gassing tests were performed at elevated temperatures on samples placed within a vacuum system coupled with a quadrapole mass spectrometer that monitored the gas or particulate species present. Out-gassing products considered normal and acceptable for metal-glass systems pumped by oil diffusion pumps are hydrogen, carbon, water, nitrogen, carbon monoxide, and carbon dioxide. Products such as methane, ethane, or other materials containing methyl or ethyl radicals, or ionizable gases such as chlorine or fluorine are considered unsuitable. Resin systems that are most suitable are free of diluents.

From the results of the various tests on samples made with several commercially available epoxy systems, it was found that ECCOBOND 104 material provided the most consistently good properties. It showed only normal out-gassing products even at 200° C. The sample was able to be heated to 200° C. without causing a pressure of greater than $2\times10^{-4}$ Torr. The material has a high glass transition temperature, high mechanical strength, and its thermal expansion coefficient can be matched to that of the sealed parts by use of appropriate filler material. The ECCOBOND 104 material includes a filled bisphenol A/epichlorohydrin based epoxy resin. While such a material has been found to meet the criteria for use in vacuum interrupters, it is also considered that useful materials can be found among other bisphenol A and also cycloaliphatic epoxy resins.

ECCOBOND 104 is an epoxy resin system supplied by Emerson and Cuming, Inc. of Canton, Mass. This epoxy is an ultrahigh temperature epoxide adhesive and is mixed with a curing agent that may be either an aromatic anhydride or an aromatic amine. The curing agent determines the glass transition temperature ($T_g$) Where the epoxy resin is mixed with an anhydride, the $T_g$ is up to about 225° C, so that the assembly process of the vacuum interrupter and subsequent normal operation can function safely up to about 200° C. Where the epoxy resin is mixed with an aromatic amine, the $T_g$, is slightly lower (about 170° C.) so that processing above about 170° C. may cause cracks and leaks in the adhesive. Within that temperature restriction, the system with an amine curing agent is quite satisfactory.

Anhydrides are solid and aromatic amines are liquid for which reason the former are more difficult to mold. However, when the epoxy resin and anhydride are mixed and heated to about 100° F. (38° C.) they become less viscous and may be molded into the forms of the envelope. When the epoxy resin and aromatic amine are mixed, the mixture is of lower viscosity which facilitates molding at room temperature.

The properties and characteristics desired for vacuum interrupter applications are met by such a polymeric system, including the glass transition temperature ($T_g$) as discussed above.

The porosity together with permeability is an indication of the potential for vacuum tightness of the interrupter. Accordingly, the polymeric epoxy resin system requires the ability to hold a vacuum of at least about $10^{-3}$ Torr for lifetime operation.

The tensile shear strength of the adhesive, as determined by rupture of the bond, between metallic surfaces at about 75° F. (24° C.) is 2500 psi and at about 300° F (149° C.) is 1800 psi. Where the surface of the joint is large, as compared to joints in conventional vacuum interrupters, 1600 psi is satisfactory with a pull strength of about 500 pounds.

The coefficient of thermal expansion may vary from $5\times10^{-6}$ inch/inch/°C. to $25\times10^{-6}$ inch/inch/°C. The coefficient of thermal expansion for the adhesive should match or be close to that of the bonded materials.

The dielectric strength should be at least about 100 volts per mil and preferably at least about 350 volts per mil.

The volume resistivity should be at least about $10^8$ ohm cm. That is, the adhesive must be insulating for the application to which it is applied.

For optimum performance at temperatures above 400° F. (204° C.), a post-cure of 12 hours at 500° F. (260° C.) is recommended.

Referring again to FIG. 5 as an illustrative embodiment, a method of assembling a vacuum interrupter in accordance with the present invention may include the following steps:

(a) contacts 115 and 117 are individually joined to their respective terminals or conductors 133 and 135 by pressing or brazing;

(b) bellows 141 and bellows shield 143 are joined to the movable contact subassembly by use of epoxy system seals or by soldering, brazing, or welding;

(c) metal end flanges 125 and 127 are joined to the respective contact subassemblies by use of epoxy system seals or by soldering, brazing, or welding;

(d) a shell 119 of an epoxy resin system is cast in a suitable mold with flanges 123 of shield 121 located to provide a formed subassembly of the shell and shield;

(e) the previous parts are assembled and end seals 129 and 131 are ready to be formed by use of an epoxy system as the sealant;

(f) exhaust tubulation 126 is joined with the end flange 127, by epoxy system or braze, as a separate subassembly;

(g) an epoxy system applied for the seals 129 and 131 is cured under vacuum until set;

(h) the vacuum enclosure comprising the shell 119, and flanges 125 and 127 is evacuated through tubulation 126 until evacuated to a pressure no more than $10^{-4}$ Torr;

(i) a post-cure bake cycle at a temperature of about 150° C. to about 200° C. for about 1 to 18 hours is performed for out-gassing;

(j) electrical cleaning is performed, while still exhausting, by applying an AC voltage, such as about 15 kV, across the open contacts and adjusting the contact spacing until discharge occurs which is then allowed to continue for about 30 min; such a step has been used in prior vacuum interrupters to season the contacts;

(k) further electrical cleaning is performed, by applying a DC voltage, such as about 200 to 300 V for about 10 min. each time while the enclosure contains a gas such as helium or argon to a pressure of about 30 Torr; this is performed by repeating, two to four times, a cycle of (i) gas fill, (ii) electrical discharge, and (iii) pump out; and (l) the exhaust tubulation 126 is then sealed.

Curing can be performed while evacuating but that is not essential. Specific cure conditions for seals made with ECCOBOND 104 material include, for example, two hours at 100° C. and two hours at 120° C. The post cure, for example, is two hours at 150° C. and 3–4 hours at 177° C.

The process takes into account the fact that a rapid thermal out-gassing is not possible with polymeric systems and therefore some degree of electrical cleaning is performed to successfully remove molecules clinging to the walls of the enclosure. While either the AC or DC discharge processes may produce a satisfactory result, it is with the combination that is presently believed the best results are obtained.

The application of polymeric systems to the design and manufacture of vacuum interrupters has the following advantages over current technology:

(1) elimination of one or more brazing steps in the manufacturing process, and in particular, the final assembly brazing step providing the potential for large savings in labor, energy costs, and capital facilities;

(2) elimination of ceramic metallization, a multi-step process involving high cost materials, multiple energy excursions for firing, capital facilities, and labor;

(3) elimination of expensive gas-tight, closely toleranced and dimensionally stable, high temperature ceramic materials;

(4) elimination of the need for expensive stainless steel structural members which are necessary in current technology because they must maintain mechanical properties after several excursions to high temperatures for brazing; and (5) elimination of the need for an expensive stainless steel bellows for the reason stated above as lower temperature processing permits the use of a lower cost bellows material.

In conclusion, the several current interrupters of this invention involve either wall structures, such as external shell portions, and/or sealed joints which consist of a polymeric material, such as epoxy systems, which are durable during temperature excursions of assembly and subsequent use and may be arranged in a variety of configurations.

What is claimed is:

1. A vacuum interrupter comprising:

a vacuum enclosure;

a pair of contacts, including at least one movable contact, enclosed by said vacuum enclosure and having respective electrical terminals connected thereto and communicating through said vacuum enclosure;

said vacuum enclosure comprising a plurality of enclosure elements with one or more seals therebetween of a cured polymeric material.

2. A vacuum interrupter in accordance with claim 1 wherein:

said plurality of enclosure elements of said vacuum enclosure includes at least one element consisting of an electrically insulating, cured polymeric material.

3. A vacuum interrupter in accordance with claim 1 wherein:

said cured polymeric material is polymeric system consisting essentially of a resin, a curing agent and a filler and has properties including absence of constituents that result in any appreciable gas production within said vacuum enclosure over a temperature range of at least from about −40° C. to about 125° C. while maintaining a vacuum tight seal over that temperature range.

4. A vacuum interrupter in accordance with claim 2 wherein:

said plurality of enclosure elements includes a generally cylindrical shell of a molded and cured polymeric system consisting essentially of a resin, curing agent and filler, a pair of metal end flanges respectively joined to said terminals with said seals of cured polymeric material between said shell and said flanges.

5. A vacuum interrupter in accordance with claim 4 wherein:

said pair of metal end flanges are joined to said terminals with a metallurgical bond therebetween.

6. A vacuum interrupter in accordance with claim 4 wherein:

said pair of metal end flanges are joined to said terminals by a seal of cured polymeric material.

7. A vacuum interrupter in accordance with claim 1 wherein:

said polymeric material is a polymeric system consisting essentially of an epoxy resin, a curing agent, and a filler.

8. A vacuum interrupter in accordance with claim 7 wherein:

said epoxy resin of said polymeric system is a bisphenol A/epichlorohydrin based epoxy resin.

9. An electrical vacuum interrupter comprising:

a pair of separable contacts;

a vacuum enclosure including an envelope having at least one open end and enclosing the contacts;

a closure for each open end which forms a joint with the envelope and which forms an evacuated chamber therewith;

the envelope being comprised of a material selected from the group consisting of a polymer system, a glass, a metal, and a ceramic; and a sealant in the joint comprising a polymeric epoxy resin having a glass transition temperature of at least about 125° C. and a porosity low enough to maintain vacuum pressures of no more than about $10^{-2}$ Torr.

10. The electrical vacuum interrupter of claim 9 in which the sealant has a coefficient of thermal expansion of from about $5\times10^{-6}$ to about $25\times10^{-6}$ inch/inch/°C. and substantially matching those of the bonded materials.

11. The electrical vacuum interrupter of claim 9 in which the sealant has a dielectric strength of at least about 100 volts/mil.

12. The electrical vacuum interrupter of claim 9 in which the sealant has a volume resistivity of greater than about $10^8$ ohm-centimeters.

13. The electrical vacuum interrupter of claim 9 in which said sealant has a curing agent which is a compound selected from the group consisting of an anhydride and an aromatic amine.

14. The electrical vacuum interrupter of claim 13 in which the curing agent is an anhydride.

15. The electrical vacuum interrupter of claim 9 in which the sealant is a bisphenol-A epoxy resin with a curing agent and a filler and has a glass transition temperature at least about 170° C.

16. The electrical vacuum interrupter of claim 15 in which the envelope comprises a bisphenol-A epoxy resin with an anhydride curing agent.

17. The electrical vacuum interrupter of claim 16 with an operating temperature range of from about −40° C. to about 150° C.

18. A method of assembling a vacuum interrupter comprising:

arranging elements of a vacuum enclosure in cooperative relationship with contacts and contact rods of the interrupter where at least certain of said elements have a layer of a polymeric system thereon as a sealant;

curing the polymeric system;

post-baking the assembly at a temperature below the glass transition temperature of the polymeric system;

cleaning, by an electrical discharge between the contacts, the interior of the vacuum enclosure.

19. A method in accordance with claim 18 wherein:

said cleaning is performed by applying an AC voltage across the contacts while the contacts are open and adjusting the contact spacing until discharge occurs during a time in which the enclosure is being continuously exhausted.

20. A method in accordance with claim 18 wherein:

said cleaning is performed by separate applications of (1) an AC voltage across the contacts while the contacts are open and adjusting the contact spacing until discharge occurs during a time in which the enclosure is being continuously outgased and (2) a DC voltage with a fill of gas selected from the group He and Ar within the enclosure for repeated cycles of gas fill, electrical discharge, and pumping out.

* * * * *